US005126766A

United States Patent [19]

Terasawa et al.

[11] Patent Number: 5,126,766

[45] Date of Patent: Jun. 30, 1992

[54] INK JET RECORDING APPARATUS INCLUDING MEANS FOR OPENING AND CLOSING AN INK SUPPLY PATH

[75] Inventors: Koji Terasawa, Mitaka; Tetsuhiro Nitta, Yokohama, both of Japan

[73] Assignee: Canon Kabushiki Kaisha, Tokyo, Japan

[21] Appl. No.: 765,499

[22] Filed: Sep. 26, 1991

Related U.S. Application Data

[63] Continuation of Ser. No. 494,400, Mar. 16, 1990, abandoned.

[30] Foreign Application Priority Data

Mar. 17, 1989 [JP] Japan ..... 1-65754

[51] Int. Cl.[5] ..... B41J 2/165

[52] U.S. Cl. ..... 346/140 R

[58] Field of Search ..... 346/140 R

[56] References Cited

U.S. PATENT DOCUMENTS 4,038,667 7/1977 Hou et al. .
4,296,418 10/1981 Yamazaki ..... 346/140 X
4,459,600 7/1984 Sato et al. .
4,558,333 12/1985 Sugitani et al. .
4,577,203 3/1986 Kawamura ..... 346/140
4,728,970 3/1988 Terasawa .
4,740,796 4/1988 Endo et al. .
4,819,012 4/1989 Kiyohara et al. .
4,893,138 1/1990 Terasawa et al. ..... 346/140
4,999,643 3/1991 Terasawa ..... 346/140

FOREIGN PATENT DOCUMENTS 52-132842 11/1977 Japan .

*Primary Examiner*—Joseph W. Hartary
*Attorney, Agent, or Firm*—Fitzpatrick, Cella, Harper & Scinto

[57] ABSTRACT

The present invention provides a liquid jet recording apparatus, comprising: an open/close means arranged in an ink supply path supplying ink to a discharge opening of a recording head, for permitting and blocking the communicaiton between the ink supply path and the discharge opening; an absorption recovering device for absorbing the ink from the discharge opening by a negative pressure; and a control means for controlling the open/close means in accordance with absorption modes of the absorption recovering device.

33 Claims, 7 Drawing Sheets

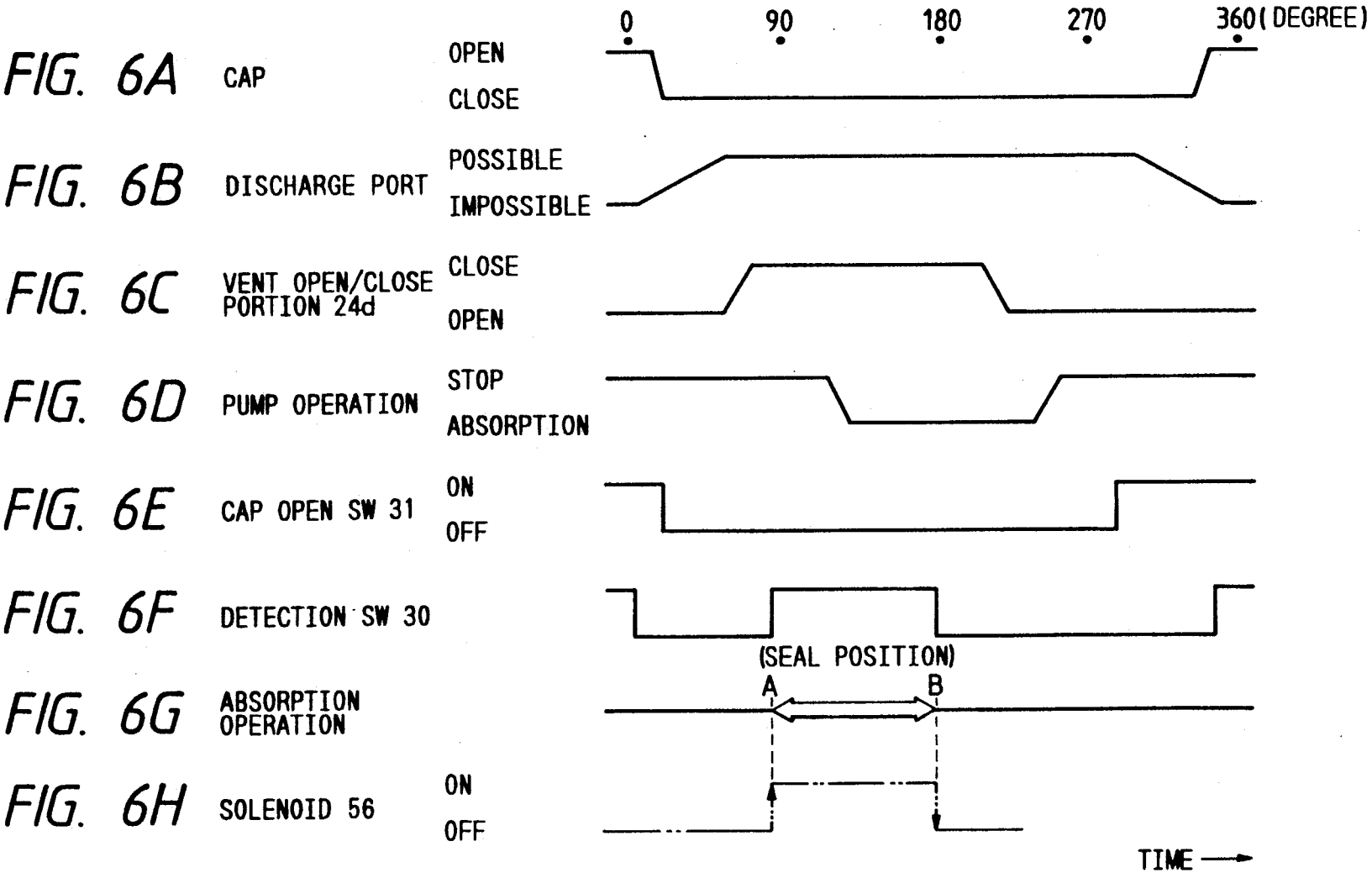
0
90
180
270
360 (DEGREE)
FIG. 6A CAP
OPEN
CLOSE
FIG. 6B DISCHARGE PORT
POSSIBLE
IMPOSSIBLE
FIG. 6C VENT OPEN/CLOSE PORTION 24d
CLOSE
OPEN
FIG. 6D PUMP OPERATION
STOP
ABSORPTION
FIG. 6E CAP OPEN SW 31
ON
OFF
FIG. 6F DETECTION SW 30
FIG. 6G ABSORPTION OPERATION
FIG. 6H SOLENOID 56
ON
OFF
(SEAL POSITION)
A
B
TIME

INK JET RECORDING APPARATUS INCLUDING MEANS FOR OPENING AND CLOSING AN INK SUPPLY PATH

This application is a continuation of application Ser. No. 07/494,400 filed Mar. 16, 1990, now abandoned.

BACKGROUND OF THE INVENTION

1. Field of the Invention

The present invention relates to a liquid jet recording apparatus having a means for recovering or restoring a discharge condition of a recording head by absorbing recording liquid from the recording head.

2. Related Background Art

A liquid jet recording apparatus such as an ink jet printer includes a carriage reciprocable in a main scanning direction along a recording medium such as a recording sheet and a recording head mounted on the carriage, and is designed such that an image is recorded on the recording medium by discharging liquid drops from discharging openings (orifices) of the recording head onto the recording medium.

In liquid jet recording apparatuses of this kind, bubbles are often mixed with the liquid in liquid paths formed in the recording head and communicating with the orifices, and/or the orifice on the end of the liquid path or the end portion of the liquid path adjacent the orifice is often clogged by the viscous liquid (ink). In such cases, the carriage is shifted to a predetermined position (for example, a home position) where the recording head is not facing to the recording medium, and the bubbles and/or viscous liquid are removed by absorbing the recording liquid (referred to as "ink" hereinafter) from the orifice through a cap by means of an absorption recovering device arranged in the recording apparatus.

Such absorption recovering devices have an absorption recovering device wherein a cap adapted to be mounted on the orifice portion of the recording head is connected to a pump through, for example, a flexible hose and the ink is absorbed from the orifice portion by a negative pressure generated by driving the pump.

When a normal head recovering operation is performed by such absorption recovering device, the ink is absorbed with low power (for example, power obtained by driving a pump having a displacement of about 0.3-0.6 cc by a single cycle) in order to reduce the excessive consumption of the ink. However, as the result of tests, it was found that when the ink is initially filled or when the ink is replenished by changing an ink tank in the case where the liquid path and liquid chamber in the recording head are emptied, unlike a normal discharge recovering operation, the absorption with high power is required for positively introducing ink into the recording head.

However, if the absorption pump having the large displacement (high power) is used, not only does the absorption mechanism become large to make the compactness of the absorption recovering device difficult, but also the amount of the absorbed ink in the normal recording operation is increased so that too much ink is not wasted. Further, it was found that, if the pump having the large displacement (capacity) is merely used, the ink is often not filled or replenished completely.

Apart from the above, a method for filling the ink as disclosed in the Japanese Patent Laid-Open No. 52-132842 (corresponding to U.S. Pat. No. 4,038,667) has already been known.

However, in this known ink filling method, when the ink must be filled after the recording head or the ink cartridge has been changed during the use of the apparatus, a considerably complicated arrangement is required for performing such method so that it takes a long time and considerable effort for filling the ink, and the initial filling operation becomes noticeably different from the bubble removing operation. Accordingly, such known filling method could not be applied to a compact and simple apparatus.

SUMMARY OF THE INVENTION

The present invention is directed to solve the above-mentioned conventional technical problems, and provides a discharge recovering apparatus, a liquid jet recording apparatus and a discharge recovering method which can fill the ink by means of discharge recovering device for recovering a good discharge condition by absorbing ink and/or air from a discharge opening.

An object of the present invention is to provide a discharge recovering apparatus, a liquid jet recording apparatus and a discharge recovering method which include at least two discharge recovering modes wherein a discharge recovery in the normal absorption recovering operation and a discharge recovery in the initial ink filling operation can be performed by a single pump.

Another object of the present invention is to provide a liquid jet recording apparatus which eliminates the above-mentioned conventional drawbacks, can be constituted by a suction pump having a small displacement (low power), can fill the ink positively, and can reduce the consumption of the ink in the normal recording operation.

In order to achieve the above object, according to the present invention, an open/close means arranged in an ink supply path for supplying ink to a recording head is controlled by a control means in accordance with an absorption mode of an absorption recovering device.

Further, the opening and closing of the open/close means may be performed by a cam mechanism included in the absorption recovering device, to easily obtain a plurality of absorption modes.

According to the recording apparatus having the above-mentioned construction, when the ink is initially filled, since the negative pressure in the recording head can be increased by driving the pump by several cycles, the ink is filled positively and completely by opening the ink supply path. Thus, the filling of the ink does not require a pump having large displacement, and, therefore, a normal pump having small capacity can be used and the excessive consumption of the ink in the normal pumping operation can be reduced.

Further, by using the cam mechanism for driving the pump of the absorption recovering device as a drive source for opening and closing the open/close means, an initial fill mode can be effected by closing the cap and then by driving the pump, and a normal absorption mode can also be effected by closing the cap and opening the supply path and then by driving the pump, in response to the rotation of the cam.

Since the control means is provided for controlling the open/close means arranged in the ink supply path (for supplying ink to the recording head) in accordance with the absorption mode of the absorption recovering device, the amount of consumption of ink in the normal absorption operation can be reduced, and the initial filling of the ink can be performed positively.

In addition, since the opening and closing of the open/close means are effected by the cam mechanism included in the absorption recovering device, a plurality of absorption modes can be easily effected without using any solenoids.

Further, since the open/close means is installed on a carriage on which the recording head is mounted, the ink filling operation can be very easily performed.

BRIEF DESCRIPTION OF THE DRAWINGS

FIGS. 6A to 6H are timing charts for explaining the operation of the absorption recovering device and a supply open/close means;

DESCRIPTION OF THE PREFERRED EMBODIMENTS

The present invention will now be fully explained with reference to the accompanying drawings.

According to a preferred aspect of the present invention, there is provided an ink jet recording apparatus having a blocking means (open/close means) arranged in an ink supply path for supplying ink to an ink discharging portion having an ink discharge opening and adapted to block the communication between the ink supply path and the ink discharging portion, absorption means for absorbing ink and/or air from the discharge opening and a drive means for driving the blocking means. The recording apparatus further includes at least a first mode for permitting the communication of the ink supply path and for then driving the absorption means, and a second mode for blocking the ink supply path and for then driving the absorption means.

The ink discharging portion preferable and adaptable to the present invention may be ones arranged in a recording head, as disclosed in U.S. Pat. Nos. 4,740,796, 4,459,600, and 4,558,333. The recording head may be of scanning type or full-line type.

The blocking means preferable and applicable to the present invention comprises, for example, a mechanical valve or a solenoid valve, and may be mounted on a carriage or may be integrally mounted on the recording head, or may be installed in other places, but, preferably, may be positioned near the ink discharging portion as illustrated in the embodiment.

The drive source for the blocking means may be an independent drive source or may be in common with the drive source for driving the absorption means and shifting the cap. The drive means preferable and applicable to the present invention may be constructed independently from the blocking means or may be constructed integrally with the blocking means, such as a solenoid valve.

Further, the recording head, ink supply path and ink supply source may be independently constructed or may be assembled together or may be constructed as a unit removably mounted on the carriage. In addition, the first and second modes may be properly selected by an operator or may be selected in response to a command signal from CPU or host computer on the basis of the detection of the filling condition of the ink.

Figure 1:
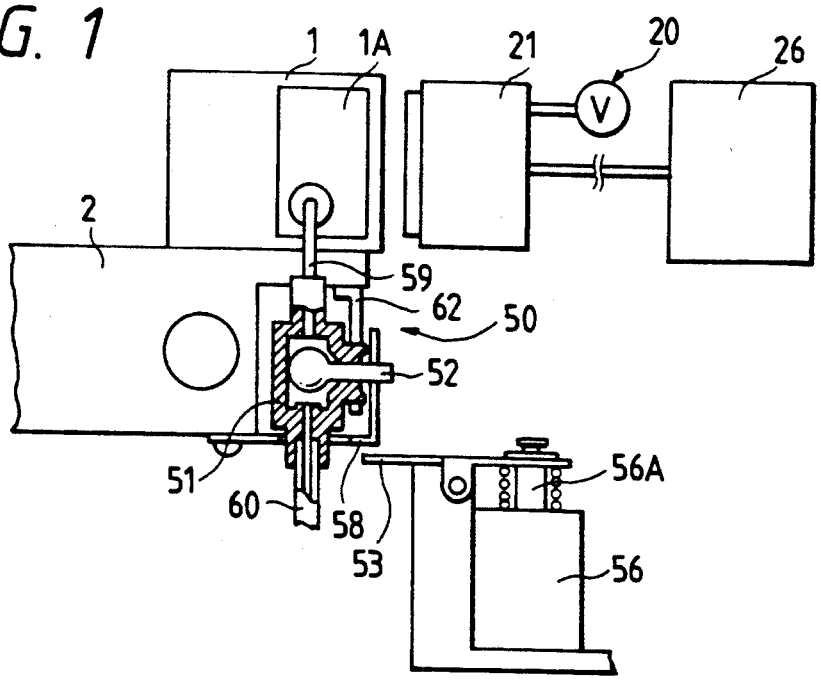
FIG. 1 is a constructural view of a main portion of a liquid jet recording apparatus according to a preferred embodiment of the present invention.
Figure 2:
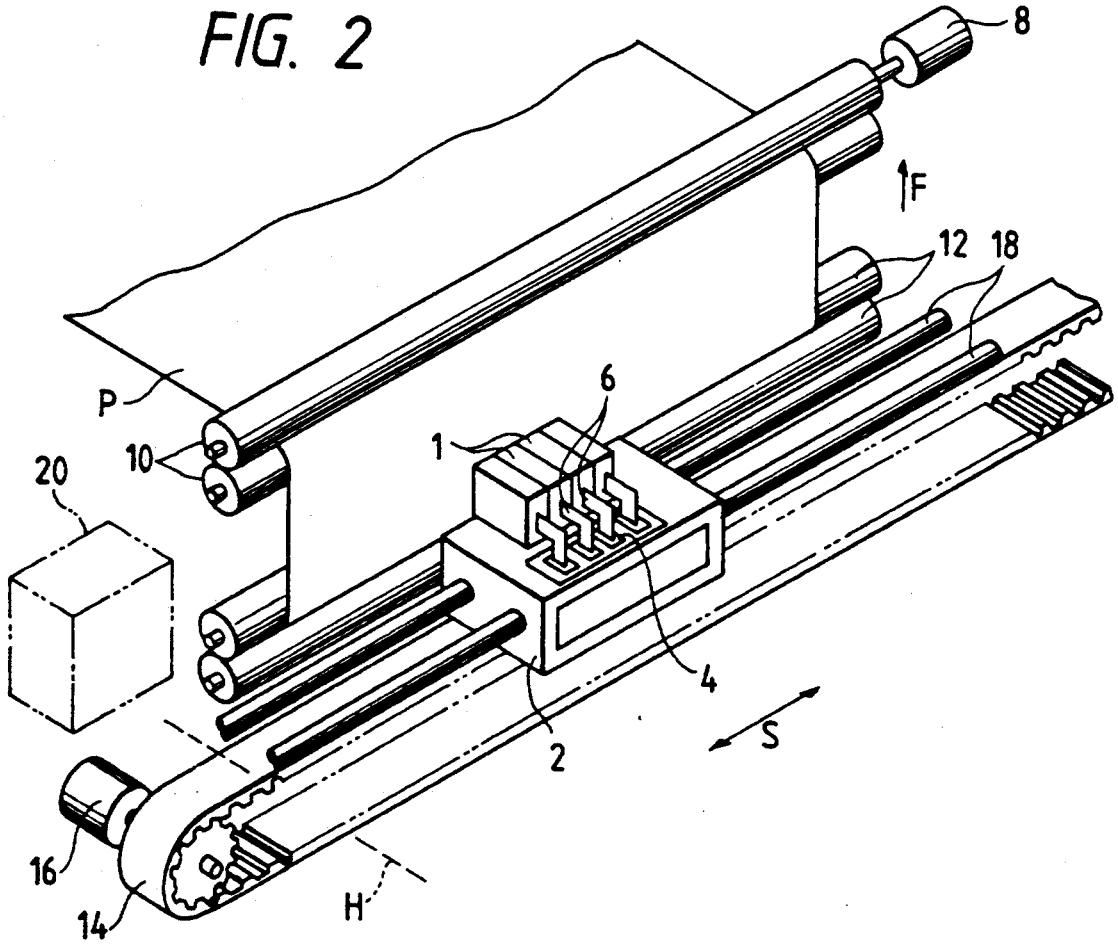
FIG. 2 is a perspective view of a recording portion of the liquid jet recording apparatus.
Figure 3:
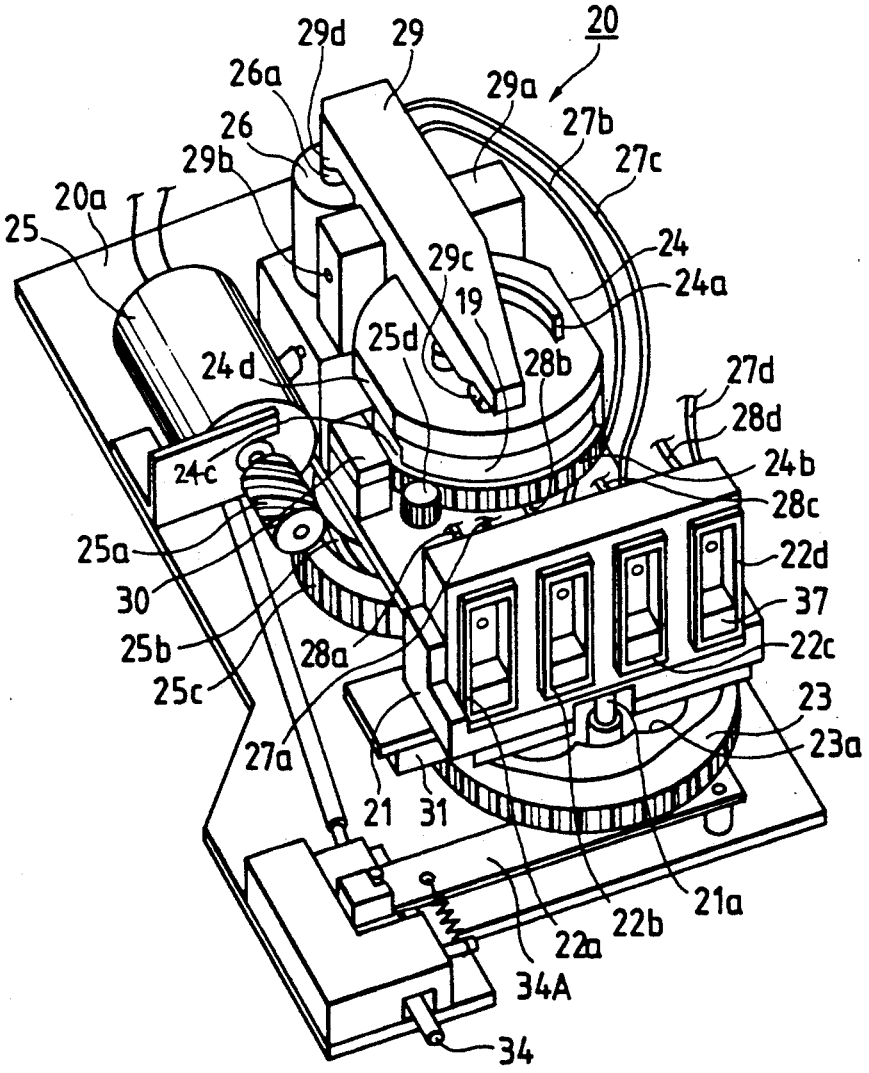
FIG. 3 is a perspective view of an absorption recovering device of the apparatus.
Figure 4:
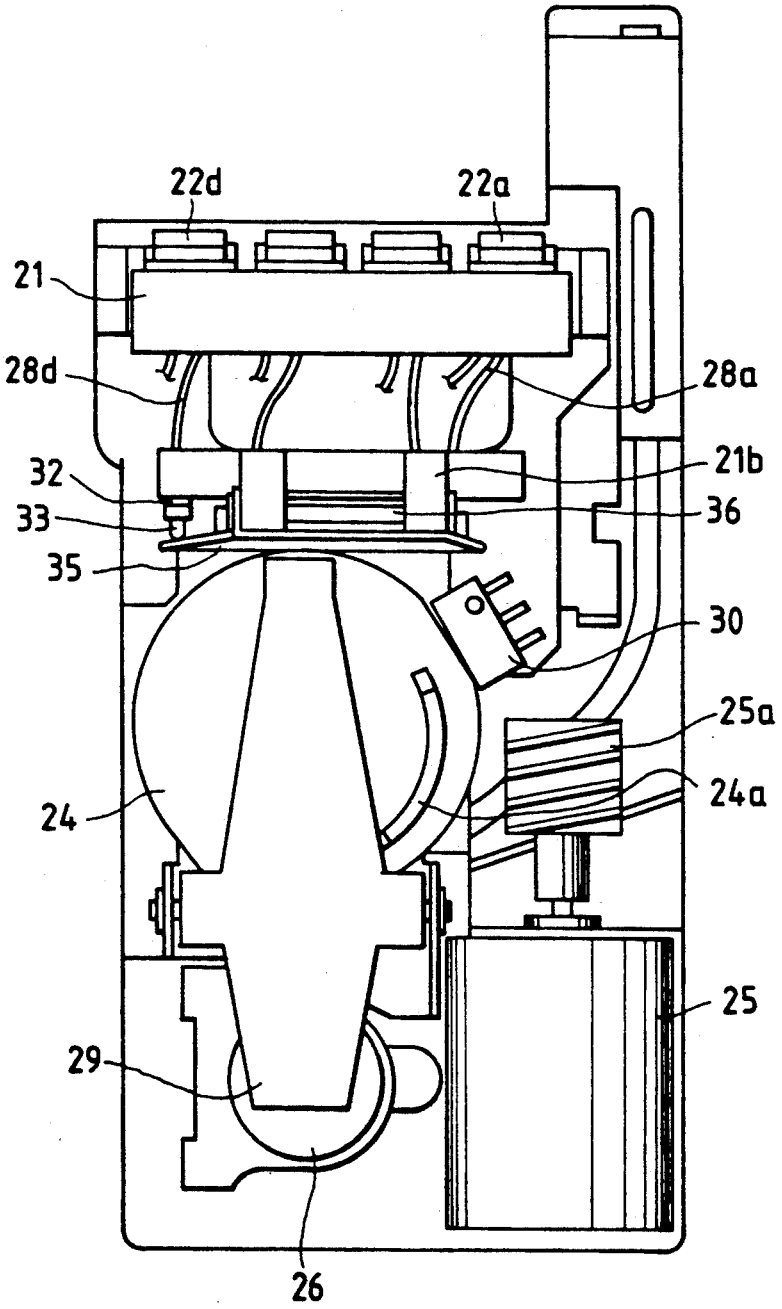
FIG. 4 is a plan view of the absorption recovering device.

Preferred embodiments of the present invention will be explained with reference to FIGS. 1 to 4, in which:

FIG. 1 is a plan view of a main portion of a preferred embodiment according to the present invention, FIG. 2 is a schematic perspective view of a recording portion of a liquid jet recording apparatus to which the present invention is applicable, FIG. 3 is a perspective view of an absorption recovering device, and FIG. 4 is a plan view of the absorption recovering device.

In FIG. 2, a recording head mounted on a carriage 2 includes ink reservoirs for storing ink supplied from an ink supply source, and recording head portions 1 having nozzles for discharging the ink stored in the reservoirs. The recording head portions 1 utilize thermal energy for discharging the ink. To this end, an electric/thermal converter is provided as thermal energy generating means in correspondence to an orifice of each recording head portion. In the illustrated embodiment, four recording head portions 1 are provided and correspond to the colors of the ink.

On the carriage 2, cartridge tanks can be removably mounted, which will be described later.

The reference numeral 4 denotes printed circuit boards for controlling the discharge of ink from the recording head 1; and 6 denotes flexible cables connecting the respective printed circuit boards 4 to the corresponding liquid jet recording head portions 1 through connectors (not shown). A recording sheet P is fed in a direction shown by the arrow F (FIG. 2) by a roller 10 driven by a sheet feed motor 8. A roller 12 cooperates with the roller 10 to straighten the recording sheet thereby providing a recording surface opposed to the recording head 1.

The reference numeral 14 denotes a carriage driving belt connected to the carriage 2; 16 denotes a carriage motor for driving the belt in a direction shown by the arrow S (FIG. 2); and 18 denotes guide rails for guiding the carriage 2. The carriage 2 is shifted along the guide rails 18 in the direction S (FIG. 2) by the energization of the motor 8, and, in a predetermined position of the carriage, an image is recorded on the recording surface of the recording sheet by the recording head 1.

Next, an absorption head recovering device 20 will be explained with reference to FIGS. 3 and 4. A reversible motor 25 is attached to a base plate 20*a* of the absorption recovering device 20 and has a motor shaft to which a pinion gear 25*a* is fixed. The pinion gear meshes with a gear 25*b*, and a pinion gear (not shown) integrally formed with the gear 25*b* meshes with a gear 25*c*.

A pinion gear 25*d* fixed to a shaft of the gear 25*c* is engaged by a gear 24*b*. A first cam plate 24 is formed integrally with the gear 24*b*, and a cam 24*a* is protruded from the upper surface of the cam plate. A second cam plate 19 is coaxially fixed to the gear 24*b* between the first cam plate 24 and the gear 24*b*. Further, a cam 24*d* is provided on the peripheral surface of the first cam plate 24 for driving a vent means 20 (FIG. 1)

Also, a cam 24c (FIG. 3) is provided on the peripheral surface of the second cam plate 19, which cam 24c is detected by a detection switch 30 comprising a microswitch and the like.

The reference numeral 29 denotes a pump lever pivotably mounted at its intermediate portion on a support frame 29a installed on the base plate 20a through a pivot shaft 29b. On one end of the pump lever, there is provided a cam follower roller 29c adapted to be engaged by the cam 24a on the first cam plate 24, and the other end of the pump lever 29 has a projection 29d abutting against a piston 26a of a pump 26. Since the piston 26a is always biased upwardly by means of a bias spring (not shown) arranged in the pump, the cam follower roller 29c is always pressed against the upper surface of the first cam plate 24.

A cap holder 21 is slidably arranged on the base plate 20a and is always biased in a direction away from the pump 26 by means of a bias spring (not shown), and a gear 23 is rotatably supported below the holder. A plurality of caps 22a–22d made of elastomer material such as rubber are fixed to the cap holder 21, and an ink absorber 37 is arranged within each cap at its lower portion. The caps are connected to the pump 26 through tubes 27a–27d, respectively. Further, the respective caps 22a–22d have vent tubes 28a–28d communicating with an open/close valve acting as the vent means.

An inner cam 23a is formed in an upper surface of the gear 23, and a shaft 21a protruding downwardly from the bottom of the cap holder 21 is engaged by the inner cam 23a through a roller. Accordingly, as the gear 23 is rotated, the movement of the cap holder 21 toward the pump is repeated by the engagement between the shaft 21a and the convex lobe of the inner cam 23a. The position of the cap holder 21 is detected by a switch 31.

Further, an upper end of a support frame 21b is pivotably supported by an upper end of a rockable lever 35 to permit the interior of each cap to vent.

Next, the ink supply recovering system of FIG. 1 will be explained.

A head supply path 59 is connected to a common liquid chamber 1A in the recording head 1, and a supply open/close means 50 is arranged between the head supply path and an ink supply path 60. The supply open/close means 50 comprises a joint 50 acting as a connecting member and an outer casing, a valve having a ball-like member 52 incorporated into the joint, and a positioning member 62 fixed to an open/close spring 58 and to the carriage 2, and is shifted integrally with the recording head 1.

Explaining the drive means for driving the supply open/close means 50, a lever 52 is provided for lifting and lowering the open/close spring 58, and is driven by a solenoid 56. The lever 53 is pivotably supported at its intermediate portion, and has one end abutting the bottom of the open/close spring 58 and the other end engaged by an armature 56A of the solenoid 56. The drive means is arranged in a home position of the recording apparatus.

In FIG. 1, when the solenoid 56 is in an inoperative condition, the lever 52 is in a horizontal condition, and, since the open/close spring 58 is not driven, the valve 52 is in a neutral position where the ink can freely flow through the joint 51. Accordingly, in this condition, the normal recording operation can be performed. Further, the cap holder 21 has been shifted far from the surface level of the recording head 1, as shown in FIG. 1.

Then, in the absorption recovering device, after the carriage 2 is shifted to the home position H (FIG. 2) and is stopped there, the cap holder 21 closes and seals the nozzle portions of the recording head 1.

Figure 5:
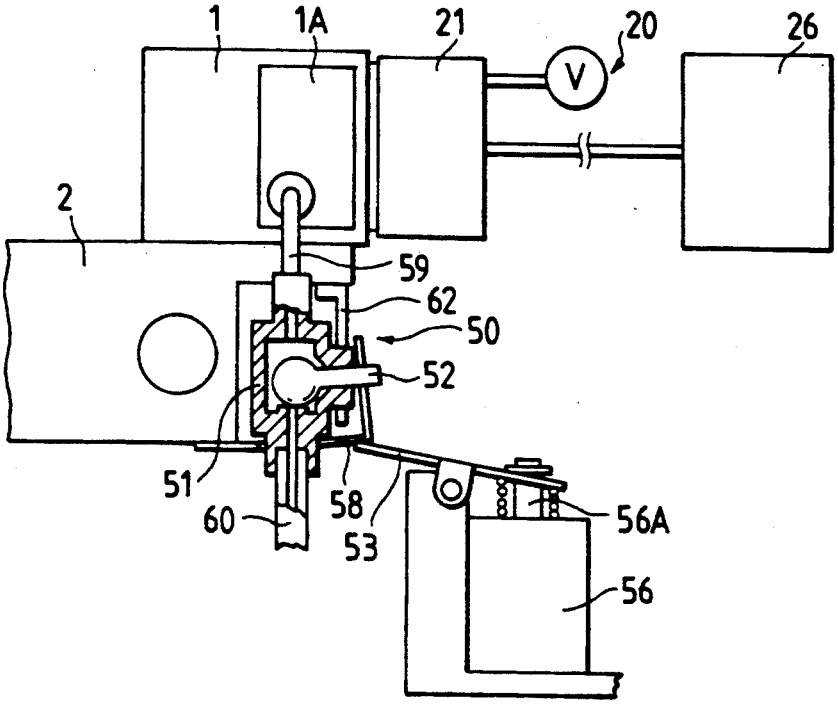
FIG. 5 is a view similar to FIG. 1, but showing a condition that an absorption recovering operation is performed.

Then, when the solenoid 56 is energized, as shown in FIG. 5, the armature 56A lowers the other end of the lever 53, whereby the one end of the lever 53 lifts the open/close spring 58. Consequently, the valve 52 is rotated in a counter-clockwise direction (FIG. 5), whereby the ball portion of the valve positioned in the joint 51 closes the outlet of the ink supply path 60. At this point, the pump 26 is driven to generate the negative pressure, which is transmitted to the cap 22a, thereby discharging the ink and/or air in the nozzle and/or liquid chamber into the cap. The ink discharged into the cap is sucked by the pump 26 to be fed to, for example, an exhaust ink tank.

Next, operations of the absorption recovering device 20 and of the supply open/close means will be explained with reference to the timing chart shown in FIG. 6.

FIG. 6 is a view for explaining the timings of the operations of the respective switches, cams and other elements. During one revolution of the first and second cam plates 24 and 19, started from a condition of "cap open", i.e., a condition that the caps 22a–22d are separated from the orifice portions of the recording head (not shown) to permit the recording, all of the controlling operations are performed.

More particularly, during one revolution of the first and second cam plates 24 and 19 integral with the gear 24b, the gear 23 is also rotated by one revolution. During this revolution, the caps are in the closed condition through almost all of the cycle as shown in FIG. 6A, and the switch 31 for detecting the opening and closing of the caps is turned OFF through almost all of the cycle as shown in FIG. 6E. The caps 22a–22d are capped onto the orifice portions such that the cam 24a is not engaged by the rockable lever 35, i.e., a condition that the tubes 28a–28d are vented.

As shown in FIG. 6C, the sequence advances to a condition of "vent close", thereafter a condition that the rockable lever 35 is engaged by the cam 24d, the roller 29c of the pump lever 29 rides on the cam 24a, thus rotating the pump lever 29 in a counter-clockwise direction (FIG. 3), whereby the absorption or suction operation by the pump 26 is performed (refer to shown in FIG. 6D).

Then, when the cam 24a is separated from the rockable lever 35 to restore the "vent open" of the vent tubes 28a–28d, the air is absorbed into the caps to eliminate the negative pressure condition therein. This absorption is a so-called "empty absorption", where the excessive ink sucked into the caps 22a–22d and retained therein is absorbed together with the air in the vent tubes 28a–28d toward the pump side, thus preventing the contamination due to leakage of ink.

The duration of the ON condition of the detection switch 30 corresponds to the duration A–B of the absorption operation as shown in FIG. 6G. By repeating the absorption operations during the duration A–B, the absorption operation can be continuously performed. In this case, the solenoid 56 is energized in response to turning ON of the detection switch 30 as shown in FIG. 6H. The above mode corresponds to the second mode.

Figure 7:
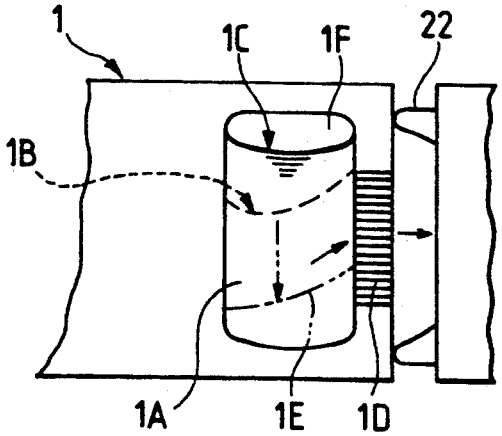
FIG. 7 is a sectional view of a common liquid chamber of a recording head of the apparatus.

When the absorption operation is performed with the valve 52 being opened as usual, for example, if the ink is not adequately filled in the recording head, as shown in FIG. 7, the liquid surface of the ink in the common liquid chamber 1A will be lowered to a lower level 1B near the top of the nozzles 1D. Consequently, the air is easily introduced into the nozzle due to the thermal expansion of the air, the creation of the bubbles or the like. That is to say, there is no discharge mergin.

According to the present invention, in this condition, by adapting the second mode reducing the pressure in the recording head by repeating the absorption operations by means of the pump 26 even with the valve 52 being closed, the residual air 1F in the common liquid chamber 1A is once depressurized to lower the liquid surface to a liquid level 1E, and, in this condition, the ink supply path is opened. Consequently, since the air above the liquid level 1E is also in the depressurized condition, the ink is introduced from the ink tank (not shown) maintained at an atmospheric pressure through the ink supply path 60 into the depressurized portion in the common liquid chamber, thus increasing the liquid level up to a liquid level 1C to obtain the stable discharge mergin.

Incidentally, the residual air layer in the common liquid chamber 1A provides a buffer function against the ink replenishment due to the ink discharge and the acceleration and deceleration of the carriage movement.

When the absorption operation cannot be performed by the normal absorption operation, for example in case of the change of the recording head, the change of the ink cartridge or the reduction of the ink level due to non-use of the device for an extended period of time, the absorption recovery is performed by properly permitting and blocking the communication of the ink supply path with respect to the operation of the pump. In this way, the positive ink filling is ensured and the ink filling time is reduced.

For example, such absorption recovery operation is performed as follows:

The absorption is performed after the ink supply path is blocked or closed, to lower the pressure (i.e., to create strong negative pressure) in the recording head and in the caps. Then, by opening the ink supply path, the ink is sucked from the ink supply source by the created negative pressure.

Or, the absorption is performed with the ink supply path being opened, to absorb the ink and air until the liquid surface is lowered to the liquid level 1B. Thereafter, the absorption is performed with the ink supply path being closed, to restore the liquid surface to the liquid level 1C, thus lowering the pressure (i.e., creating strong negative pressure) in the recording head and in the caps. Then, by opening the ink supply path, the ink is sucked from the ink supply source by the created negative pressure.

Figures 8A, 8B, 8C, 8D, 8E, 8F, 8G, 8H, 8I, 8J:
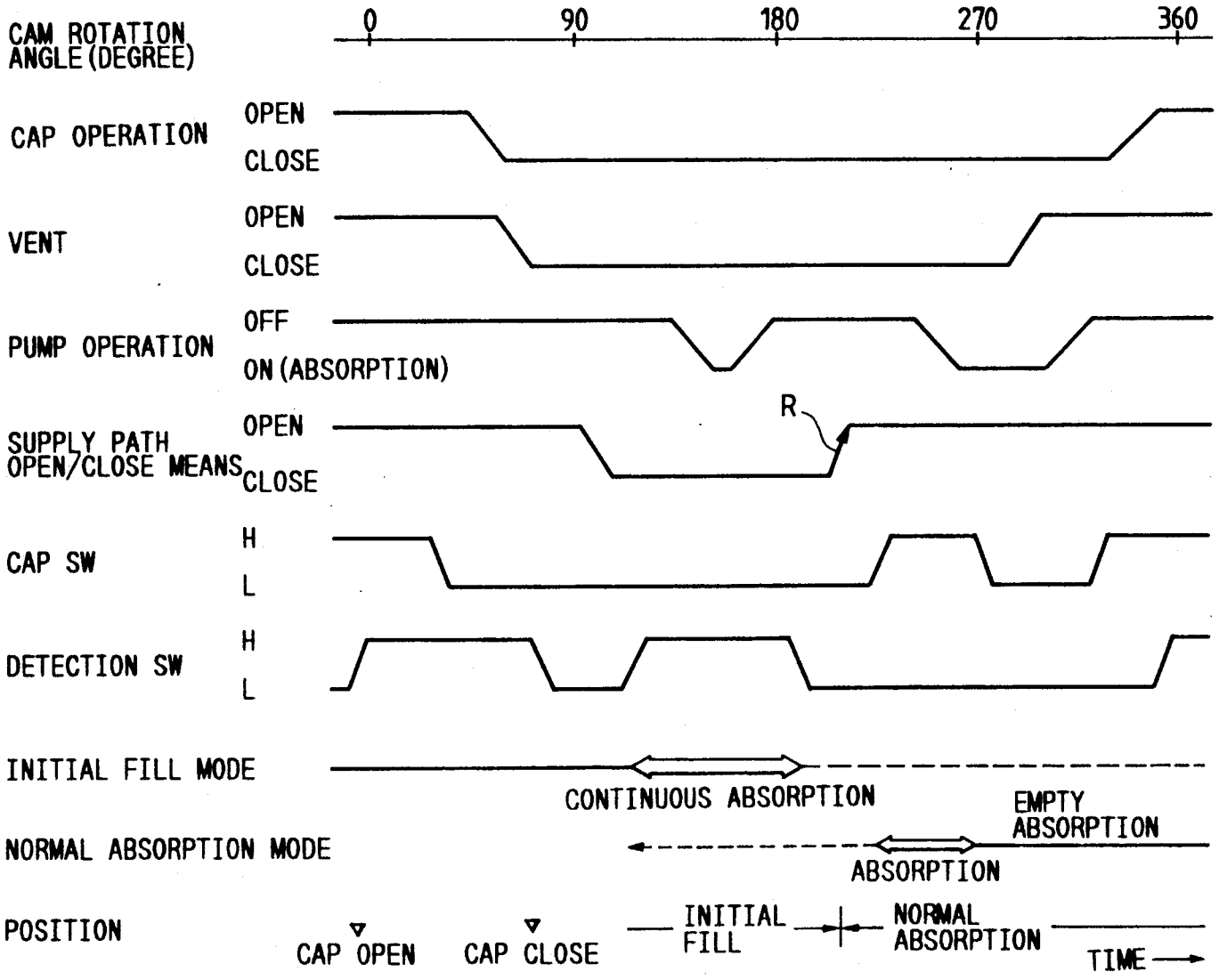
FIGS. 8A to 8J are timing charts according to another embodiment.

FIG. 8 shows a timing chart according to another embodiment of the present invention. This embodiment is characterized in that the absorption operation is made into plural, that is, an initial filling mode and a normal absorption mode, without using driving means such as a solenoid.

In order to recover the poor discharge of ink due to the increase in the viscosity of ink in the nozzle tip or due to the bubbles in the nozzle, which is normally apt to occur, the absorption of a little ink from the nozzle is adequate, and accordingly, the absorption operations may be performed once or twice at most. On the other hand, in the initial ink filling mode where the ink must be filled in the ink supply path 60 and in the common liquid chamber 1A, in order to discharge the undesired air and the viscous ink toward the negative pressure source side (pump side), it is necessary to suck a large amount of ink. The selection of the above modes can be effected with a simple construction, for example by using a cam mechanism. That is to say, as shown in FIG. 8, in a range 0°-220° of the rotation of the cam, the initial ink filling operation is performed, and, in a range 220°-360° of the rotation of the cam, the normal recovering or absorption operation is performed. For example, if the initial ink filling mode is selected by an appropriate switch input (key input, command input from the host computer and the like), first of all, the caps 22 and the ink supply path are closed, and then the absorption operation is effected by driving pump 26. Similarly, if the mode is changed from the initial ink filling mode to the normal absorption mode by another switch input, the ink supply path is opened with the caps 22 being closed, and then the absorption operation and the empty absorption operation are effected by driving the pump 26, thus establishing the normal absorption mode.

Incidentally, the cam plates 24 and 19 are reversibly rotated, and the working positions thereof are determined by the cap switch 31 and the detection switch 30. Further, the control of the opening and closing of the ink supply path is performed as shown by R in FIG. 8, in which case the cam is operated to open the valve quickly for filling the ink into the common liquid chamber quickly.

Figure 9:
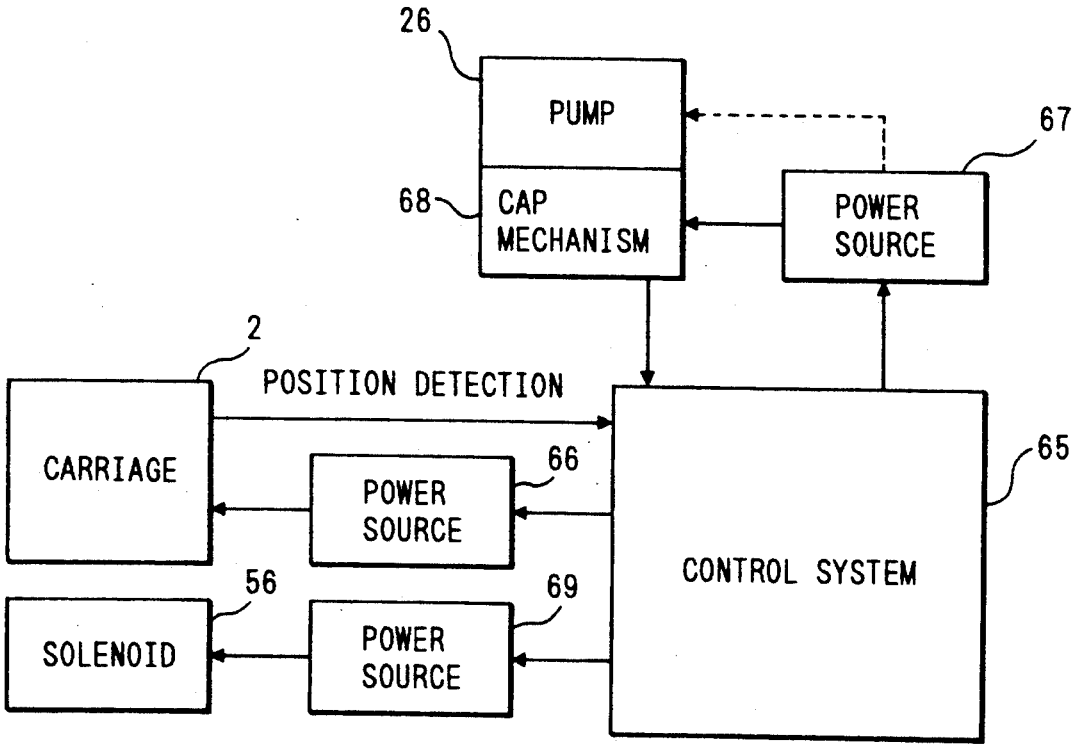
FIG. 9 is a control block diagram for driving the absorption recovering device.

FIG. 9 shows a control block diagram for driving the absorption recovering device 20.

In FIG. 9, the reference numeral 65 denotes a control system comprising a microcomputer, memories and an interface. Connected to the control system 65, is a drive source 66 for driving the carriage 2, a drive source 67 for rotating the pump 26 and for driving a cap mechanism 68 to shift the cap holder 21, and a drive source 69 for energizing and the solenoid 56. The control system 65 controls the respective drive sources to carry out the timing as shown in FIG. 6 or FIG. 8 on the basis of a position detection signal from the carriage and detection signals from the respective switches.

It is needless to say that the embodiment of FIG. 8 does not require the solenoid 56 and driving source 69.

What is claimed is:

1. An ink jet recording apparatus comprising:

a recording head having an ink discharge opening for discharging ink;

a suction mechanism for sucking the ink from said recording head through said ink discharge opening by applying negative pressure to said ink discharge opening;

a cap member communicating with said suction mechanism for capping said ink discharge opening;

an ink supply path for supplying the ink to said discharge opening of said recording head;

an open/close mechanism associated with said ink supply path for opening and closing said ink supply path; and a mechanism for capping said ink discharge opening with said cap member and closing said ink supply path with said open/close mechanism to form a sealed internal chamber between said open/close mechanism and said suction mechanism, wherein operation of said suction mechanism creates an increased negative pressure in the sealed internal chamber.

2. An ink jet recording apparatus according to claim 1, wherein said recording head is provided with an energy generating element comprising an electro-thermal converting member for generating energy for discharging ink.

3. An ink jet recording apparatus according to claim 1, wherein said open/close mechanism is provided on a carriage on which said recording head is mounted.

4. An ink jet recording apparatus according to claim 1, wherein said open/close mechanism is driven by a drive source used for driving said cap member.

5. An ink jet recording apparatus according to claim 1, wherein said suction mechanism is a pump.

6. An ink jet recording apparatus according to claim 1, wherein the internal chamber can be communicated with the atmosphere and an idle ink discharge can be performed for discharging the ink from said ink discharge opening into said cap member to be sucked by said suction mechanism.

7. An ink jet recording apparatus according to claim 1, wherein plural recording heads each having an ink supply path are provided and plural caps are provided on said cap member for capping each said recording head, and wherein an open/close mechanism is provided for each ink supply path, said suction mechanism using a single pump.

8. An ink jet recording apparatus comprising:

a recording head having an ink discharge opening for discharging ink;

suction means for sucking the ink from said recording head through said ink discharge opening by applying negative pressure to said ink discharge opening;

cap means communicating with said suction means for capping said ink discharge opening;

an ink supply path for supplying the ink to said discharge opening of said recording head;

open/close means associated with said ink supply path for opening and closing said ink supply path;

means for capping said ink discharge opening with said cap means and closing said ink supply path with said open/close means to form a sealed internal chamber between said open/close means and said suction means, wherein operation of said suction means creates an increased negative pressure in the sealed internal chamber.

9. An ink jet recording apparatus according to claim 8, wherein said recording head is provided with an energy generating element comprising an electro-thermal converting member for generating energy for discharging ink.

10. An ink jet recording apparatus according to claim 8, wherein said open/close means is provided on a carriage on which said recording head is mounted.

11. An ink jet recording apparatus according to claim 8, wherein said open/close means is driven by a drive source used for driving said cap means.

12. An ink jet recording apparatus according to claim 8, wherein said suction means is a pump.

13. An ink jet recording apparatus according to claim 8, wherein the internal chamber can be communicated with the atmosphere and an idle ink discharge can be performed for discharging ink from said ink discharge opening into said cap means to be sucked by said suction means.

14. An ink jet recording apparatus according to claim 8, wherein plural recording heads each having an ink supply path are provided and plural caps are provided on said cap means for capping each said recording head, and wherein an open/close means is provided for each ink supply path, said suction means using a single pump.

15. An ink jet recording apparatus comprising:

a recording head having an ink discharge opening for discharging ink;

a suction mechanism for sucking the ink from said recording head through said ink discharge opening by applying negative pressure to said ink discharge opening;

a cap member communicating with said suction mechanism for capping said ink discharge opening;

an ink supply path for supplying the ink to said ink discharge opening of said recording head;

an open/close mechanism associated with said ink supply path for opening and closing said ink supply path, said apparatus being operable in a first mode wherein said ink supply path is opened by said open/close mechanism and said ink discharge opening is capped by said cap member and said suction mechanism sucks the ink from said ink discharge opening, and a second mode, wherein said ink discharge opening is capped by said cap member and said ink supply path is closed by said open/close mechanism to form a sealed internal chamber between said open/close mechanism and said suction mechanism and said suction mechanism creates an increased negative pressure in the sealed internal chamber and said ink supply path is then opened to release the increased negative pressure and suck ink from said discharge opening; and a selection mechanism for selecting the first mode or the second mode.

16. An ink jet recording apparatus according to claim 15, wherein said recording head is provided with an energy generating element comprising an electro-thermal converting member for generating energy for discharging ink.

17. An ink jet recording apparatus according to claim 15, wherein said open/close mechanism is provided on a carriage on which said recording head is mounted.

18. An ink jet recording apparatus according to claim 15, wherein said open/close mechanism is driven by a drive source used for driving said cap member.

19. An ink jet recording apparatus according to claim 15, wherein said suction mechanism is a pump.

20. An ink jet recording apparatus according to claim 15, wherein the internal chamber can be communicated with the atmosphere and an idle ink discharge can be performed for discharging ink from said discharge opening into said cap member to be sucked by said suction mechanism.

21. An ink jet recording apparatus according to claim 15 wherein plural recording heads each having an ink supply path are provided and plural caps are provided on said cap member for capping each said recording head, and wherein an open/close mechanism is provided for each ink supply path, said suction mechanism using a single pump.

22. A recovery mechanism which can be adapted to an ink jet recording apparatus in which recording is effected by discharging ink from a recording head having an ink discharge opening, comprising:

a suction mechanism for sucking ink from said recording head through said ink discharge opening by applying negative pressure to said ink discharge opening;

a cap member communicating with said suction mechanism for covering said ink discharge opening;

an open/close mechanism associated with an ink supply path that connects said discharge opening of said recording head to an ink storage portion that stores the ink, said open/close mechanism provided for opening and closing said ink supply path; and a mechanism for capping said ink discharge opening with said cap member and closing said ink supply path with said open/close mechanism to form a sealed internal chamber between said open/close mechanism and said suction mechanism, wherein operation of said suction mechanism creates an increased negative pressure in the sealed internal chamber and said open/close mechanism then opens said ink supply path to release the increased negative pressure and suck ink from said ink discharge opening.

23. A recovery mechanism according to claim 22, wherein said recording head is provided with an energy generating element comprising an electro-thermal converting member for generating energy for discharging ink.

24. A recovery mechanism according to claim 22, wherein said open/close mechanism is provided on a carriage on which said recording head is mounted.

25. A recovery mechanism according to claim 22, wherein said open/close mechanism is driven by a drive source used for driving said cap member.

26. A recovery mechanism according to claim 22, wherein said suction mechanism is a pump.

27. A recovery mechanism according to claim 22, wherein the internal chamber can be communicated with the atmosphere and an idle ink discharge can be performed for discharging ink from said ink discharge opening into said cap member to be sucked by said suction mechanism.

28. A recovery mechanism for an ink jet recording apparatus that effects color recording by discharging ink from a recording head having plural ink discharge openings, comprising:

a cap provided with plural cap portions for capping each of said discharge openings individually;

a suction mechanism communicating with the plural cap portions for sucking the ink from said discharge openings by applying negative pressure to said discharge openings;

ink supply paths for supplying ink to said discharge openings of said recording head;

an open/close mechanism associated with said ink supply paths for opening and closing said ink supply paths; and a control mechanism for capping said ink discharge openings with said cap and closing said ink supply paths with said open/close mechanism to form a sealed internal chamber between said open/close mechanism and said suction mechanism, wherein operation of said suction mechanism creates an increased negative pressure in the sealed internal chamber and said control mechanism then opens said ink supply path to release the increased negative pressure and suck ink from said ink discharge opening.

29. A recovery mechanism according to claim 28, wherein said recording head is provided with energy generating elements comprising electro-thermal converting members for generating energy for discharging ink.

30. A recovery mechanism according to claim 28, wherein said open/close mechanism is provided on a carriage on which said recording head is mounted.

31. A recovery mechanism according to claim 28, wherein said open/close mechanism is driven by a drive source used for driving said cap.

32. A recovery mechanism according to claim 28, wherein said suction mechanism is a pump.

33. A recovery mechanism according to claim 28, wherein the internal chamber can be communicated with the atmosphere and an idle ink discharge can be performed for discharging ink from said ink discharge opening into said cap to be sucked by said suction mechanism.

* * * * *

UNITED STATES PATENT AND TRADEMARK OFFICE

CERTIFICATE OF CORRECTION

PATENT NO. : 5,126,766

DATED : June 30, 1992

INVENTOR(S) : KOJI TERASAWA, ET AL.

It is certified that error appears in the above-identified patent and that said Letters Patent is hereby corrected as shown below:

COLUMN 1

Line 32, "to" should be deleted.
Line 64, "not" should be deleted.

COLUMN 5

Line 48, "joint 50" should read --joint 51--.
Line 55, "lever 52" should read --lever 53--.
Line 64, "lever 52" should read --lever 53--.

COLUMN 7

Line 7, "mergin" should read --margin--.
Line 22, "mergin" should read --margin--.

COLUMN 8

Line 39, "and" should read --and deenergizing--.

COLUMN 9

Line 38, "path;" should read --path; and--.

--

UNITED STATES PATENT AND TRADEMARK OFFICE

CERTIFICATE OF CORRECTION

PATENT NO. : 5,126,766

DATED : June 30, 1992

INVENTOR(S) : KOJI TERASAWA, ET AL.

It is certified that error appears in the above-identified patent and that said Letters Patent is hereby corrected as shown below:

COLUMN 10

Line 54, "15" should read --15,--.

Signed and Sealed this

Twenty-fourth Day of August, 1993

Bruce Lehman

*Attest:*

BRUCE LEHMAN

*Attesting Officer*

*Commissioner of Patents and Trademarks*

--